US005822830A

United States Patent [19]

Lin

[11] Patent Number: 5,822,830

[45] Date of Patent: Oct. 20, 1998

[54] HANDLE FOR L SHAPED TOOL

[76] Inventor: Chiang Her Lin, No.22-8, Jiann Dong Rd., Dah Li City, Taichung, Taiwan

[21] Appl. No.: 897,586

[22] Filed: Jul. 21, 1997

[51] Int. Cl.[6] ..... A47B 95/02

[52] U.S. Cl. ..... 16/111 R; 16/114 R; 81/177.1; 81/489

[58] Field of Search ..... 16/111 R, 114 R, 16/110 R, 110.5; 81/177.1, 489, 487, 521, 901; 7/167

[56] References Cited

U.S. PATENT DOCUMENTS

| | | | |
|---|---|---|---|
| 1,095,851 | 5/1914 | Grafton | 81/177.1 |
| 1,786,029 | 12/1930 | Philips | 81/177.1 |
| 1,980,087 | 11/1934 | Rast | 81/117.1 |
| 2,437,762 | 3/1948 | Simonin | 81/177.1 |
| 2,475,268 | 7/1949 | Wittle | 81/489 |
| 2,672,777 | 3/1954 | Dossie | 81/489 |
| 4,996,896 | 3/1991 | Bachand et al. | 81/489 |

*Primary Examiner*—Chuck Mah
*Attorney, Agent, or Firm*—Charles E. Baxley, Esq.

[57] ABSTRACT

A handle for engaging with an L-shaped tool includes a beam having a bore for engaging with one of the stems and includes a bar having a groove communicating with the bore for engaging with the other stem. A cover is secured to the bar for securing the tool in place and for allowing the tool to be solidly secured in the handle. The bar includes a pair of channels, the cover includes a pair of flanges for slidably engaging with the channels and for allowing the cover to be secured to the bar.

4 Claims, 6 Drawing Sheets

HANDLE FOR L SHAPED TOOL

BACKGROUND OF THE INVENTION

1. Field of the Invention

The present invention relates to a handle, and more particularly to a handle for an L-shaped tool.

2. Description of the Prior Art

Typical L-shaped tools, such as allen wrenches, comprise an L-shaped body having two ends for engaging with and for driving fasteners. However, the user have to hold and to rotate the hexagonal outer portion the allen wrenches such that the user may feel pain after use.

The present invention has arisen to mitigate and/or obviate the afore-described disadvantages of the conventional tools.

SUMMARY OF THE INVENTION

The primary objective of the present invention is to provide a handle for engaging on the L-shaped tool and for facilitating the operation of the L-shaped tool.

In accordance with one aspect of the invention, there is provided a handle for engaging with an L-shaped tool having a first stem and a second stem, the handle comprises a beam including a bore for engaging with the first stem, and a bar perpendicular to the beam, the bar including a groove communicating with the bore of the beam for engaging with the second stem, and a cover secured to the bar for securing the second stem in place and for allowing the tool to be solidly secured in the handle.

The bar includes a pair of channels, the cover includes a pair of flanges for slidably engaging with the channels of the bar and for allowing the cover to be secured to the bar.

The cover includes a pair of slots for defining the flanges and for allowing the flanges to slidably engage with the channels of the bar.

The bar includes a first groove, the cover includes a second groove, the first groove and the second groove form an engaging hole for engaging with the second stem of the tool.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
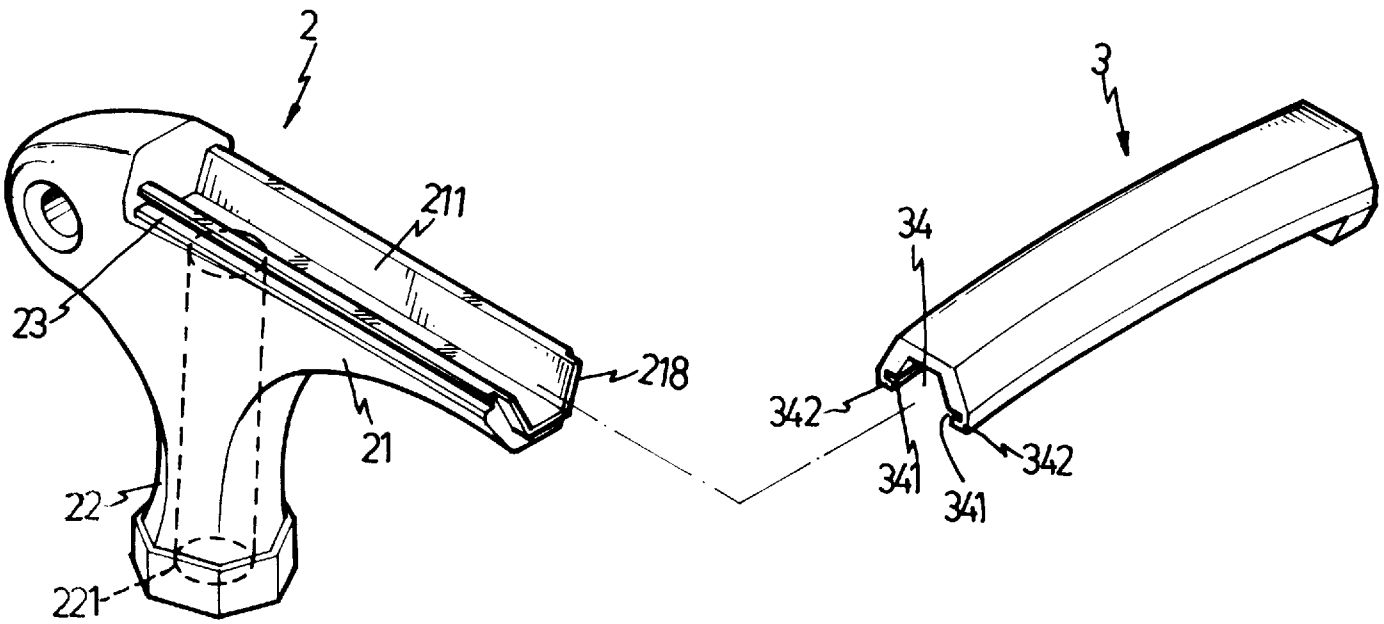
FIG. 1 is an exploded view of a handle in accordance with the present invention.
Figure 2:
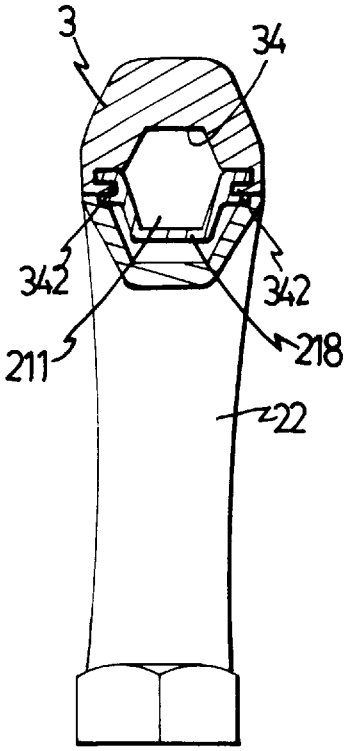
FIG. 2 is a partial cross sectional view of the handle.
Figure 7:
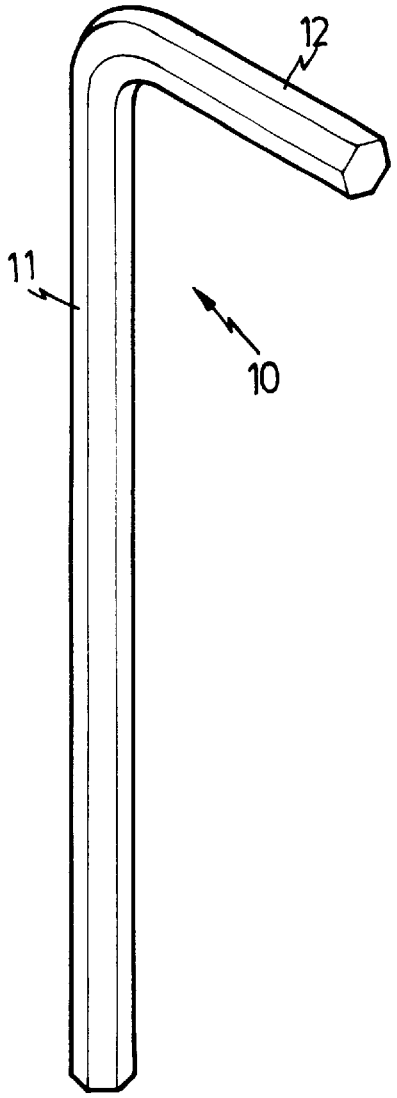
FIG. 7 is a perspective view of a allen wrench to which the handle is engaged.
Figure 5:
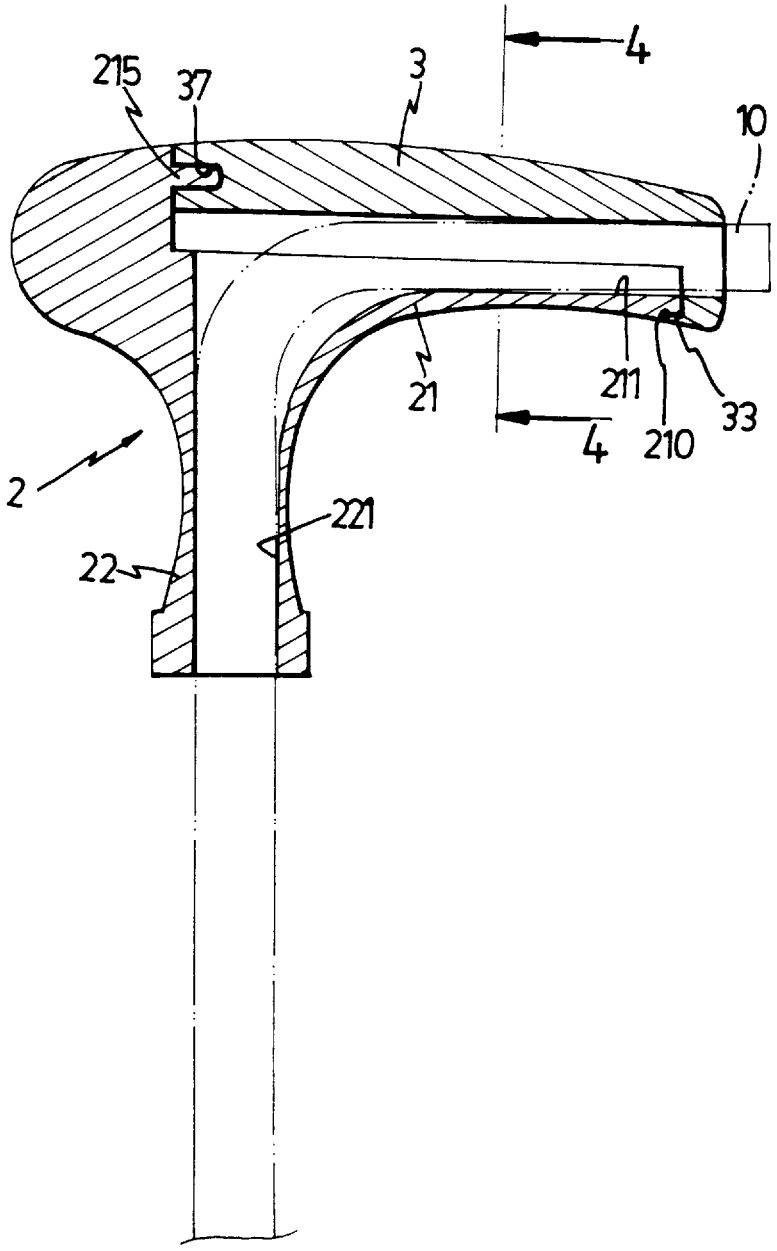
FIG. 5 is a cross sectional view taken along lines 5—5 of FIG. 4.
Figure 6:
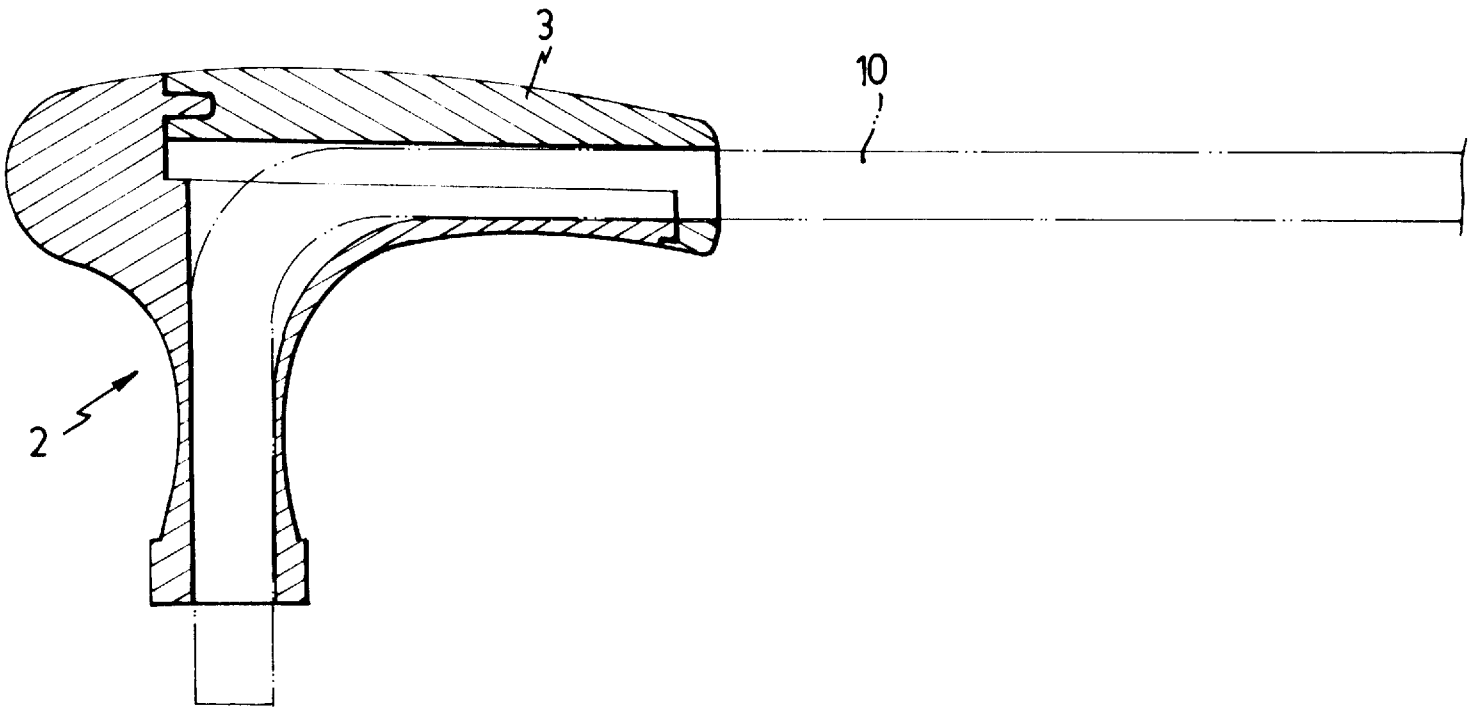
FIG. 6 is a cross sectional view similar to FIG. 5, illustrating the operation of the handle.

Referring to the drawings, and initially to FIGS. 1 and 2, a handle in accordance with the present invention is provided for engaging with an L-shaped tool, such as an allen wrench 10 as shown in FIG. 7. The L-shaped tool 10 includes two stems 11, 12 of different lengths for engaging with fasteners. The handle 2 comprises an L-shaped body 2 including a bar 21 and a beam 22 which are preferably perpendicular with each other. The beam 22 includes a bore 221 for engaging with one of the stems 11, 12 of the tool 10 (FIGS. 5, 6). The bar 21 includes a groove 211 for engaging with the other stem 11, 12 of the tool 10 and includes a pair of channels 23 for engaging with a cover 3. The groove 211 may be directly formed in top of the bar 21 or may be formed by a member 218 having a U-shaped cross section (FIG. 2). The cover 3 includes a pair of slots 341 so as to define a pair of flanges 342 which are slidably engaged with the channels 23 of the bar 21 for allowing the cover 3 to be secured to the handle 2. It is preferable that the cover 3 includes a groove 34 corresponding to the groove 211 of the bar 21 for allowing the grooves 211, 34 to form an engaging hole and to engage with the other stem 11, 12 of the tool 10 (FIGS. 5, 6). The tool 10 may be easily engaged into the bore 221 of the beam 22 and the grooves 211, 34 before the cover 3 is secured to the bar 21. The cover 3 may secure the tool 10 in place and may secure the handle 2 to the tool 10 such that the tool 10 may be easily operated by holding the handle 2.

Figure 3:
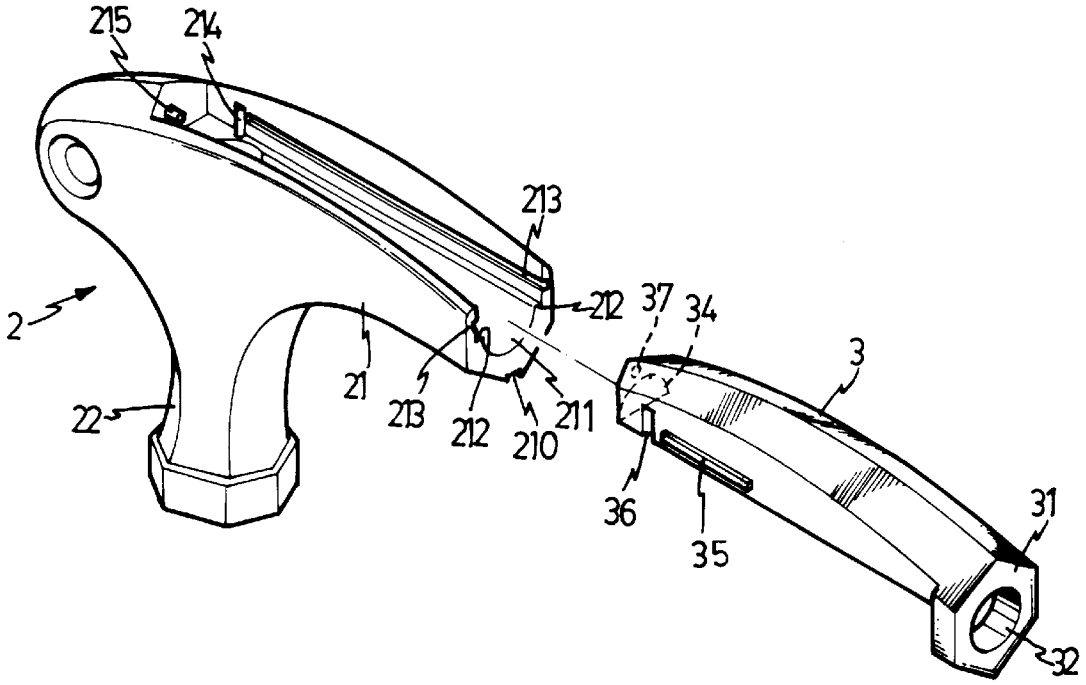
FIG. 3 is an exploded view of another application of the handle.
Figure 4:
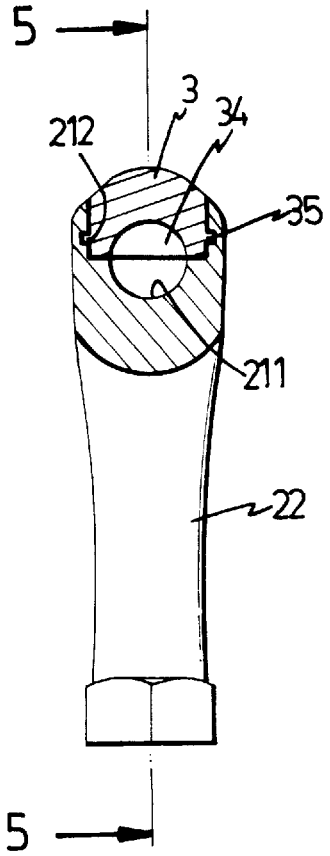
FIG. 4 is a cross sectional view taken along lines 4—4 of FIG. 5.

Referring next to FIGS. 3 to 5, alternatively, the bar 21 may include a pair of channels 213 for slidably engaging with two flanges 35 of the cover 3 and for allowing the cover 3 to be secured to the bar 21. The bar 21 includes a pair of shoulders 212 for engaging with the bottom portions of the cover 3 (FIG. 4), and includes a pair of side projection 214 for engaging with a pair of notches 36 of the cover 3 (FIG. 3), and includes a pin 215 for engaging with an aperture 37 of the cover 3 (FIGS. 5, 6), for allowing the cover 3 to be solidly secured to the bar 21 of the handle 2. The cover 3 includes a ring 32 for engaging with one stem 11, 12 of the tool 10 before the cover 3 is slidably engaged onto the bar 21, and for allowing the cover 3 to be solidly engaged with the stem 11, 12 of the tool 10.

The bore 221 of the beam 22 and the grooves 211, 34 of the bar 21 are not necessarily formed with hexagonal cross section. No matter what the cross sections of the bore 221 and of the grooves 211, 34 are, the stems 11, 12 of the tool 10 may be solidly engaged in the bore 221 and the grooves 211, 34 of the handle 2 and may be solidly rotated by the handle 2 when the stems 11, 12 are engaged in the bore 221 and the grooves 211, 34.

Accordingly, the handle in accordance with the present invention includes a beam and a bar for engaging with the stems of the L-shaped tool and for facilitating the operation of the L-shaped tool.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A handle for engaging with an L-shaped tool having a first stem and a second stem, said handle comprising:

a beam including a bore for engaging with the first stem, and a bar perpendicular to said beam, said bar including a groove communicating with said bore of said beam for engaging with the second stem, and a cover secured to said bar for securing the second stem in place and for allowing the tool to be solidly secured in said handle.

2. The handle according to claim 1, wherein said bar includes a pair of channels, said cover includes a pair of flanges for slidably engaging with said channels of said bar and for allowing said cover to be secured to said bar.

3. The handle according to claim 2, wherein said cover includes a pair of slots for defining said flanges and for allowing said flanges to slidably engage with said channels of said bar.

4. The handle according to claim 2, wherein said cover includes a second groove, said groove of said bar and said second groove of said cover form an engaging hole for engaging with the second stem of the tool.

* * * * *